US006508041B1

(12) United States Patent
Boot

(10) Patent No.: US 6,508,041 B1
(45) Date of Patent: Jan. 21, 2003

(54) INTERLOCKING CONCRETE BLOCK

(76) Inventor: Daniel Anthony Leonard Boot, 818 Piedmont Gardens, Victoria, British Columbia (CA), V8Y 2T2

( * ) Notice: Subject to any disclaimer, the term of this patent is extended or adjusted under 35 U.S.C. 154(b) by 84 days.

(21) Appl. No.: 09/695,389

(22) Filed: Oct. 25, 2000

Related U.S. Application Data

(60) Provisional application No. 60/161,065, filed on Oct. 25, 1999.

(51) Int. Cl.[7] ..... E04B 2/64

(52) U.S. Cl. ..... 52/578; 52/603; 52/604; 52/596; 52/591.1

(58) Field of Search ..... 52/574, 589.1, 52/591.1, 590.2, 590.3, 592.6, 596, 604, 603, 98, 503, 570, 569, 561, 578, 588.1

(56) References Cited

U.S. PATENT DOCUMENTS

| | | | | | |
|---|---|---|---|---|---|
| 716,865 | A | * | 12/1902 | Choquet et al. | 52/590.2 |
| 828,930 | A | * | 8/1906 | Crampton | 52/604 |
| 866,360 | A | * | 9/1907 | Hill | 52/591.1 |
| 1,540,128 | A | * | 6/1925 | Houston | 52/589.1 |
| 2,021,133 | A | * | 11/1935 | Munson | 52/589.1 |
| 3,135,505 | A | * | 6/1964 | Agnew | 52/589.1 |
| 3,170,201 | A | * | 2/1965 | Nofziger | 52/604 |
| 3,562,988 | A | * | 2/1971 | Gregoire | 52/589.1 |
| 4,704,832 | A | * | 11/1987 | Vassiliadis | 52/279 |
| 4,896,999 | A | * | 1/1990 | Ruckstuhl | 405/286 |
| 6,035,599 | A | * | 3/2000 | Sonnentag | 52/604 |
| 6,071,041 | A | * | 6/2000 | Knight | 405/16 |
| 6,205,735 | B1 | * | 3/2001 | Witcher | 52/604 |

FOREIGN PATENT DOCUMENTS

CA 2220257 5/1998

OTHER PUBLICATIONS

Brochure—Lok Blok—(5 pages).

* cited by examiner

*Primary Examiner*—James O. Hansen
*Assistant Examiner*—Phi Dieu Tran A
(74) *Attorney, Agent, or Firm*—Adrian D. Battison; Michael R. Williams; Ryan W. Dupuis

(57) ABSTRACT

A block for use in interlocking with other similar blocks in constructing a building has a block body having a top surface and a bottom surface with an outer block wall defining one side surface of the block body. A head portion extends from the outer block wall toward an opposed side surface. A connecting portion on respective sides of the head arranged to receive at least one correspondingly shaped connection portion of at least one second block in interlocking relationship therewith. Two abutment portions are arranged each at a respective end of the outer block wall and each defining a respective abutment shoulder. A groove is provided in the head portion at a position thereon opposite to the outer block wall defining two shoulders for engaging and retaining the abutment portions of two abutting blocks

16 Claims, 4 Drawing Sheets

INTERLOCKING CONCRETE BLOCK

This application claims the benefit of Provisional application Ser. No. 60/161,065, filed Oct. 25, 1999.

FIELD OF THE INVENTION

The present invention relates to an interlocking concrete block system for constructing buildings and the like.

BACKGROUND

Interlocking concrete blocks used in constructing buildings is relatively common to one involved in the construction field. Interlocking concrete block buildings are generally built with a plurality of interlocking concrete blocks. Current methods of concrete block buildings use blocks which are long and unstable in certain building conditions.

SUMMARY

The present invention is an interlocking dry-stack concrete masonry building system used for the construction of load bearing and non-load bearing masonry walls. The design of the concrete block has several advantages over conventional masonry block building systems.

A few of these advantages are:

a) Coursing: Provide easy levelling of the first course regardless of foundation conditions; maintaining straight and plumb walls without using string lines; maintain correct and accurate modular wall lengths; enhance structural capacity and stability of the structure during and after construction.

b) An off-set and stacking bond configuration is unique for distribution of compressive forces and self-levelling of block coursing.

c) Dry-stack construction eliminates the use of mortar and making construction under severe weather or site conditions possible.

d) Offset double-wythe construction to enhance resistance to water penetration, thermal properties fire resistance and flexibility in the use of special architectural features.

e) Moment or bending capacity in horizontal and vertical directions, unreinforced.

f) Network of interlocking configuration to absorb energy from impact and compensate for irregularities or settlement in foundations and footing.

The modular dimensions for the block of the present invention are nominally 400 mm long, 200 mm high and 150 mm wide. The standard stretcher block has identical matching profiles with a built in 6 mm tolerance in order to accommodate variable deformities and irregularities inherent the casting of the moulds. In order to achieve lighter weight concrete blocks a center opening 100 mm diameter centered in the block. Curved node profiles with alternating 67 mm radius interior radius and exterior 70 mm radius enable the alternating block to lock into the opening created and anchors the block from rotating outwards. The exterior 'legs' of the block is thickened 45 mm×50 mm which assembled together with the following block will fit into a 20 mm×100 mm extrusion formed into the center of the original block. The assembly of the adjacent blocks with prevent the total assembly from rotating or moving in a longitudinal direction. Each plane is chamfered 10 mm in order to create mass and resist abrasion or breakage. The vertically offset, interlocking double-wythe construction provides moment capacity in both the horizontal and vertical out-of-plane directions, and shear capacity in the out-of-plane and in-plane directions. The combination of stacking and running bond configuration provides compressive strength capacity by distributing forces laterally through the wall to the foundation.

The combined 200 mm wide wall are intended for use as external and internal load-bearing and non-load bearing wall and are intended for use in single story residential dwellings. These structures will be unreinforced to a large degree.

According to the present invention there is provided a block for use in constructing buildings comprising an outer face, a head extending from the outer face and a connecting portion on respective sides of the head. The connection portion is arranged to receive at least one connection portion of at least one second block such that the blocks are interconnected.

BRIEF DESCRIPTION OF THE DRAWINGS

In the accompanying drawings, which illustrate an exemplary embodiment of the present invention.

DETAILED DESCRIPTION

Figure 1:
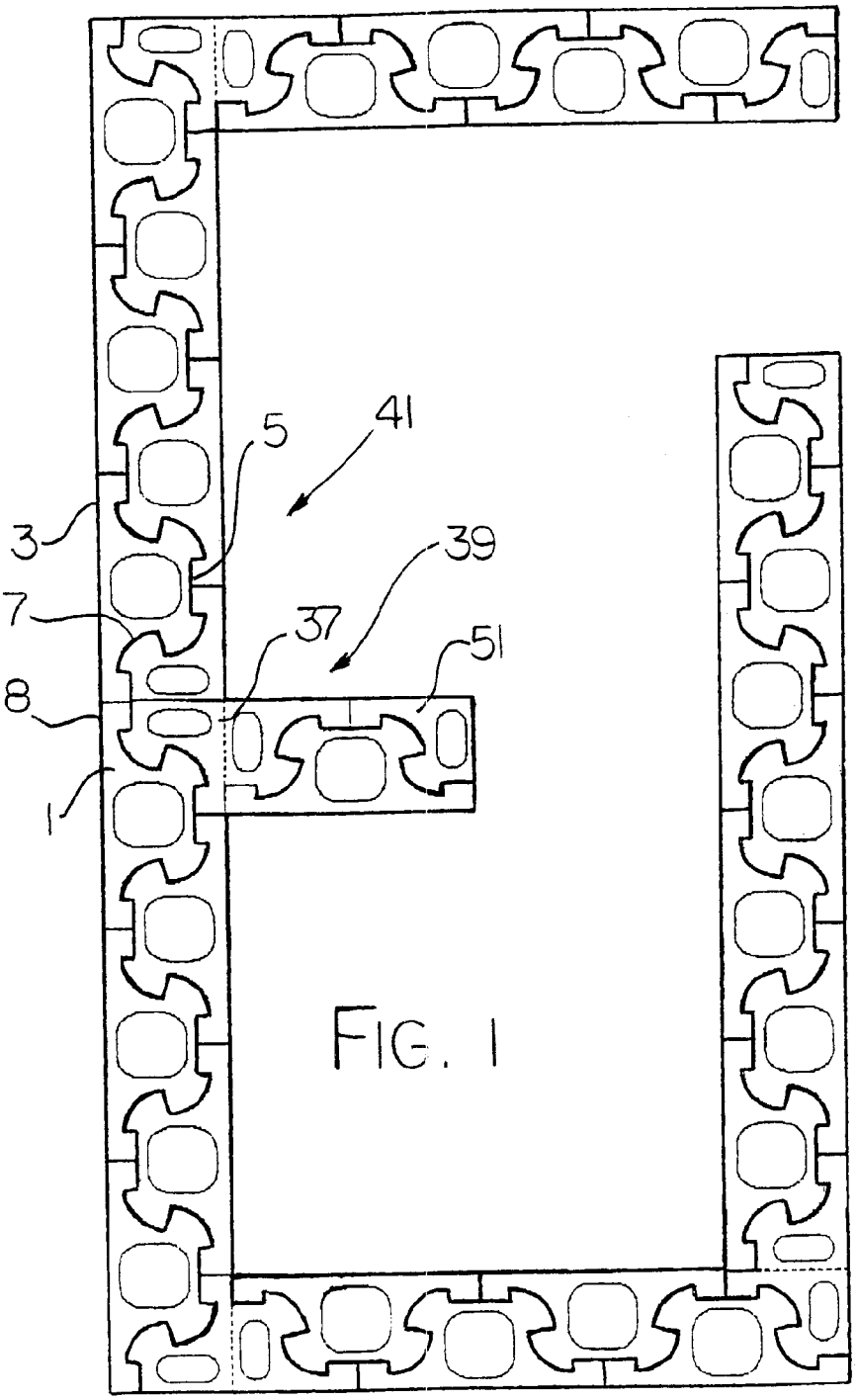
FIG. 1 is a top plan view of walls of a building which is constructed by the present invention.
Figure 2:
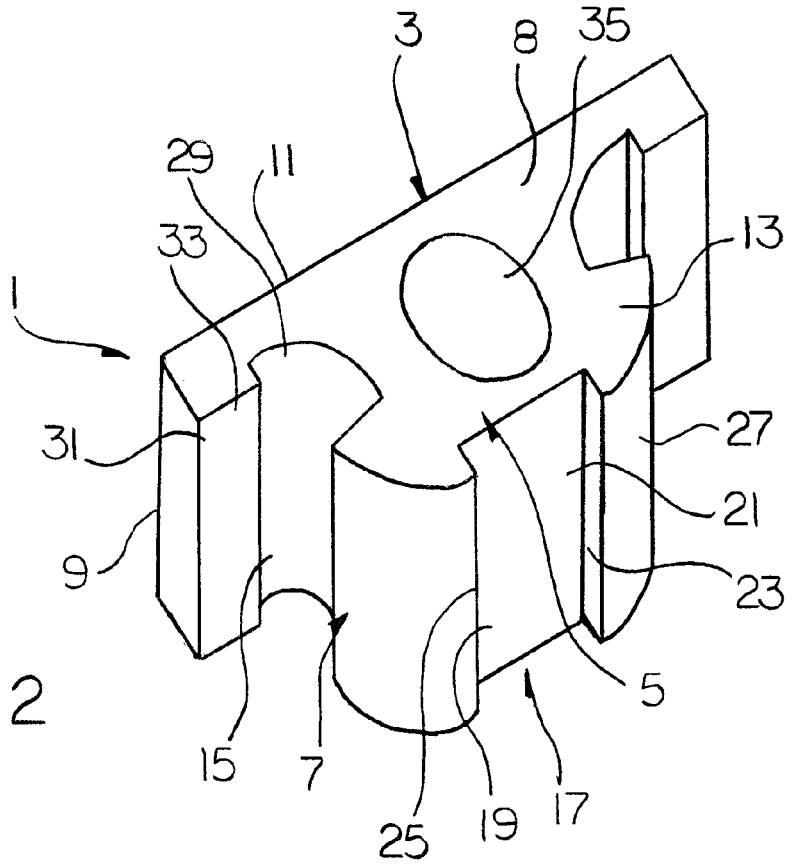
FIG. 2 is an isometric view of the present invention.

Referring to the accompanying drawings, there is illustrated a block 1 which is used in constructing building has an outer face 3, a head 5 and side portions 7. The outer face is a generally flat surface 8 and rectangular in shape having outer edges 9 which are shorter in length than top and bottom edges 11. The outer edges are generally vertical in orientation and the top and bottom edges are generally horizontal in orientation.

The head on the block extends outwards from a respective side of the outer face relative to the flat surface. The head extends such that there is a flat top and bottom surface 13 and inwardly concave sides 15, defining the side portion. The top end 17 of the head has a vertical slot 19 which extends from the top surface to the bottom surface such that the slot has a back 21 and two sides 23 perpendicular to the back coming to an edge 25 at the top of the head. A sloped side 27 extend outward and rearward from the edge 25 and come to a concave 29 which extends inward and rearward such that the block at the head is wider that the block at the side portion but is shorter in width at the head than at the outer face. A flange 31 at the rear end of the concave extends forwardly parallel to the outer edges and has a front surface 33 extend perpendicular therefrom to the outer edges. A hole 35 is located at the top surface and extends through the block to the bottom surface such that concrete or the like can be located within the block for support, as described later.

The block body has a top surface and a bottom surface, with an outer block wall defining one side surface of the block body. A head portion extends from the outer block Wall toward an opposed side surface. The connecting portion on respective sides of the head is arranged to receive at least one correspondingly shaped connection portion of at least one second block in interlocking relationship therewith. Two abutment portions each at a respective end of the outer block wall and each defining a respective abutment shoulder engage into the groove in the head portion at a position thereon opposite to the outer block wall defining two shoulders for engaging and retaining the abutment portions of two abutting blocks.

The groove has shoulders substantially at right angles to the outer block wall.

The head portion has a hole centrally thereof and extending from the top surface to the bottom surface.

The connecting portions are lobe shaped.

There is defined between the abutment portion and the connecting portion a receptacle substantially matching in shape the connecting portion.

The system includes a joiner block having an element shaped the same as an abutment portion on the side of the head portion opposite to the outer block wall.

The system includes an end block substantially equal to one half of the other blocks.

Figure 3:
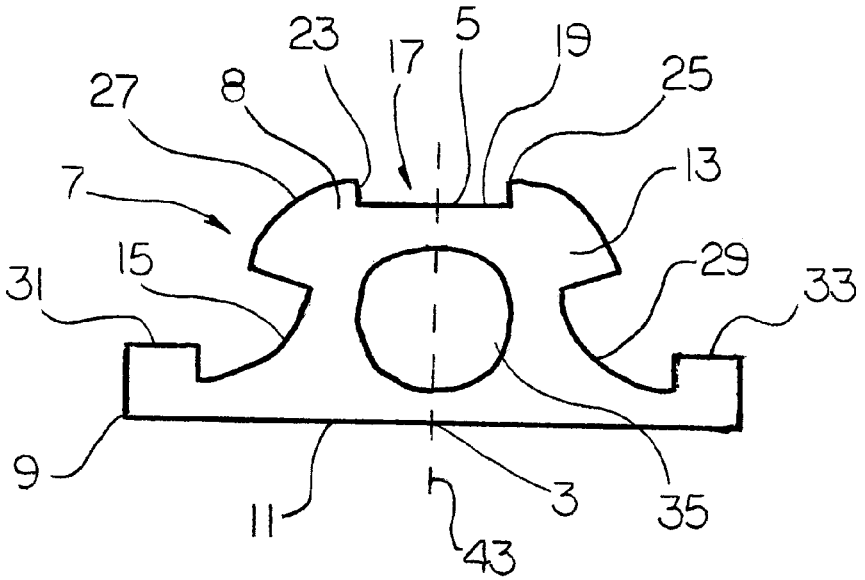
FIG. 3 is a top plan view of the embodiment shown in FIG. 2.
Figure 4:
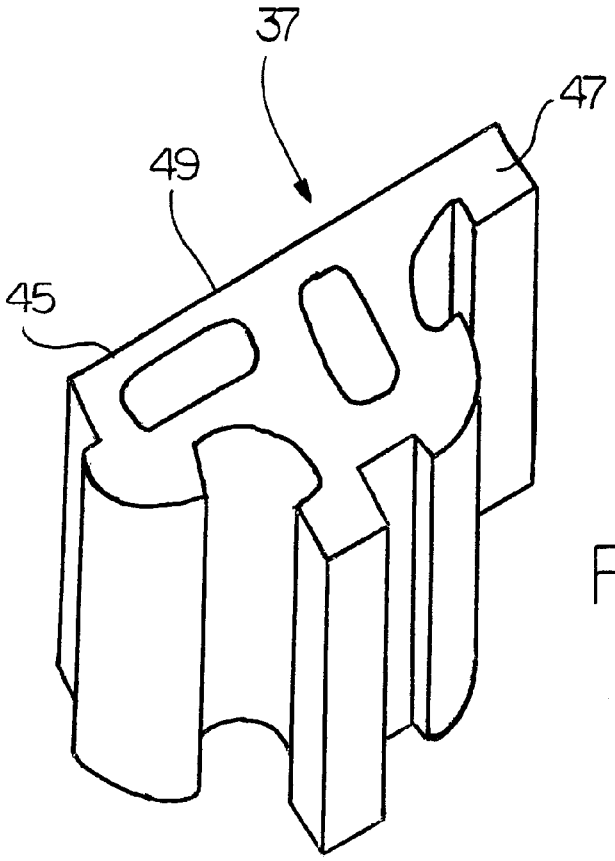
FIG. 4 is an isometric view of a second embodiment of the present invention.
Figure 5:
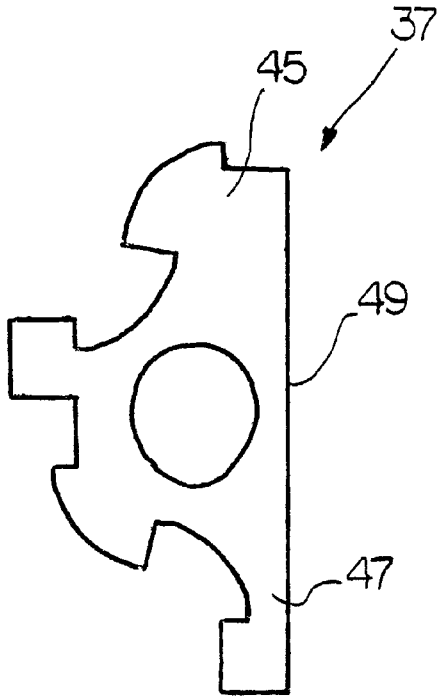
FIG. 5 is a top plan view of the embodiment shown in FIG. 4.

A second embodiment of the block is shown in FIG. 4 and 5 wherein a corner block 37 is arranged for making corners 39 in a wall 41. The corner block is a product of the block 1 such that block 1 is separated vertically along a separation line 43, shown in FIG. 3. The separation line is perpendicular to the outer face and cuts the block in two equally sized pieces through the head at the slot. The corner block is then a product of the two pieces such that the outer surface of a first piece 45 is at the separation line connected to the head such that the flange is located at the slot and the head on the first piece faces outwardly for connecting to a block. The separation line of the first piece is parallel with the outer face of a second piece 47 such that a second outer face 49 is formed by the corner block.

Figure 6:
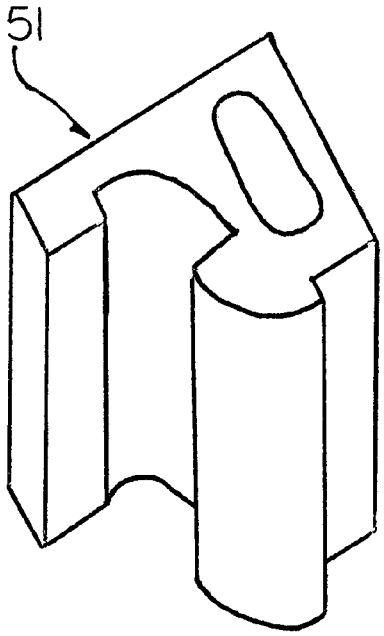
FIG. 6 is an isometric view of a third embodiment of the present invention.
Figure 7:
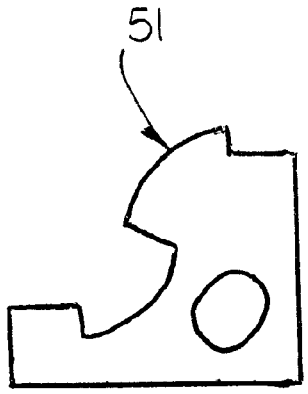
FIG. 7 is a top plan view of the embodiment shown in FIG. 6.

A third embodiment is shown in FIGS. 6 and 7 wherein the block is cut along the separation line to form an end block such that the block 1 can be cut into two end blocks.

The wall of a building is shown in FIG. 1 wherein the concrete block building system is a modular system based on the nominal dimensions of 150 mm wide, 200 mm high and 400 mm long. Wall lengths between adjacent corners can be designed in increments of 200 mm, with the shortest span from one outside corner to the other outside corner being 400 mm.

The shortest distance between a corner and an adjacent window or door opening is 400 mm and can be increased in increments of 200 mm by alternating the orientation of the end unit and using the end block.

Interlocking concrete block walls will commonly be built directly upon strip footings which should be constructed in accordance with local building codes and conditions. The footings should be designed and built according to the modular length considerations.

The top surface of the footing should be reasonably level and sufficiently rough to bond with the concrete in fill used to fill the first course of the blocks. The first course of blocks are levelled on the footing using wedges and are then filled with concrete in fill thus automatically correcting for deviations from level in the top surface of the footing.

Steel reinforcing bar dowels are cast into the foundation at appropriate intervals and at corners, i.e. 1200 mm spacing and extend vertically through the cores of the first course of block into the wall. When these cores are filled with concrete in-fill a sound, foundation-to-wall connection is created.

The first course of blocks is placed along the perimeter of the structure. Stretcher units are placed on the external side of the wall to begin the external wythe and half height stretcher units are placed on the internal side of the wall to begin the internal wythe. All corner units are full height. When the first course has been completed it is filled with concrete in-fill which flows down into the cavity. Once this concrete has cured it becomes an effective bearing pad between the foundation and completes the foundation-to-wall connection.

After the first course all subsequent courses consist of stretcher units and other full height units, except where coursing is levelled at window sills with half-high stretcher units. Note the internal and external coursing are always offset by one half of a block height as a result of placing half high stretchers on the first course of the internal wythe creating a "woven" pattern, providing shear strength of the completed wall diaphragm. Walls should be built consistently, course by course, in one continuous direction, not from two points or comers towards an intermediate point.

Corners are constructed using the standard corner block. Alternating the orientation of the corner block by inverting it on each successive course initiating the running bond pattern on the external wythe of the wall. The corner cores are reinforced with steel reinforcing bars and concrete in-fill after completion of the coursing.

Corner blocks and end blocks are reinforced with #10M or #15M reinforcing bars and concrete in-fill. This reinforcement connects foundation doweling to the roof plate ensuring a positive foundation-to-roof connection. The cores of the stretcher units are also reinforced with #10M bars as engineering design specifies.

Reinforcement of appropriate diameter and wall thickness can be installed in the circular cores to maintain vertical plumb during construction and to add stiffness to the wall structure. The bars extends from the foundation, where it engages a reinforcing bar dowel cast into the footing, up to the level of the roof. When the coursing is completed, the cores are filled with a high slump, fine aggregate concrete in-fill, and an anchor bolt is cast into the top of the core for connection to the roof assembly. In this manner the entire structure is stiffened.

End units are used on each side of window and door openings and are reinforced with steel and concrete in-fill.

Half height blocks are used to level coursing at sills and top of walls.

A unique design feature of the present invention is the assembly of the pre-cast lintel beams that are specifically designed to span the standard window and door openings. The openings are pre-sized to suit each opening and are 400 mm high×150 mm thickness. Utilizing pre-cast beams where required for load bearing, locks the top coursing into the wall plane and provides the horizontal strength to the structure.

Alternately, the first course of lintel blocks is interlocked with the regular coursing of the wall and is temporarily supported. Coursing then continues in the standard manner until the desired beam depth is reached, at which time the beam is filled solid with concrete in-fill. When the concrete in-fill has cured sufficiently, the temporary support is removed.

Partition walls are constructed with the 150 mm wide concrete block wall system using the same design and construction procedures as for external walls. Connection of a partition wall to an external wall utilizes the corner block alternating with the end block. This type of connection is placed at the base of intersecting walls and terminating at the roof plane.

A typical wall plan of a single story low cost house constructed with the concrete block of the present invention is illustrated on the attached plan. All corners and intersections of exterior and interior portion walls are reinforced with #10M reinforcing bars which extend from foundation to roof plate and resist uplift forces on the roof. The jambs of all door and window openings are reinforced with #10M bars and concrete in-fill.

For gable construction, a pre-cast concrete lintel beam or formed cast-in-place bond beam are used to finish the top edge of the gable.

Lintel construction for window and door openings can be constructed using the following alternative. Steel door and window frames incorporating beam channels to support header coursing and light roof loads could be used. A pressure treated wood header beam at the top of the wall plate is also possible. In this case, wooden 'false work' would be used to fill in the upper portion of the window opening. The suitability of these, alternatives will depend on the various applications and conditions encountered in the field. For spans of 1.5 meters and less, these alternatives should prove successful and serve to cut costs and enhance the "self help" aspects of the system.

To increase the waterproofing of the exterior walls, plaster can be applied in the external side of the exterior wall planes. If desired, plaster can be applied to both sides of assembled concrete block walls to provide a satisfactory level of finishing.

While one embodiment of the present invention has been described in the foregoing, it is to be understood that other embodiments are possible within the scope of the invention. The invention is to be considered limited solely by the scope of the appended claims.

What is claimed is:

1. A block for use in interlocking with other similar blocks in constructing a building comprising:

a block body having a top surface and a bottom surface, the block body having:

an outer block wall defining one side surface of the block body;

a head portion extending from the outer block wall toward an opposed side surface; and two connecting portion on a respective side of the head portion;

two abutment portions each at a respective end of the outer block wall and each defining a respective abutment shoulder;

and a single central groove in the head portion at a position thereon opposite to the outer block wall, the groove at opposite ends thereof defining two inwardly facing shoulders each for engaging and retaining the abutment portion of a respective one of two abutting blocks such that the abutment portions are retained end to end within the single groove;

wherein there is defined between the abutment portion and the connecting portion a receptacle substantially matching in shape the connecting portion for receiving in interlocking relationship the connecting portion of a co-operating interlocking block.

2. The block according to claim 1 wherein the groove has shoulders substantially at right angles to the outer block wall.

3. The block according to claim 1 wherein the head portion has a hole centrally thereof and extending from the top surface to the bottom surface.

4. The block according to claim 1 wherein the connecting portions are lobe shaped.

5. An interlocking block system comprising a plurality of blocks arranged for use in interlocking with other similar blocks in constructing a building, at least some of the blocks comprising:

a block body having a top surface and a bottom surface, the block body having:

an outer block wall defining one side surface of the block body;

a head portion extending from the outer block wall toward an opposed side surface; and two connecting portions each on a respective side of the head portion;

two abutment portions each at a respective end of the outer block wall and each defining a respective abutment shoulder;

and a single central groove in the head portion at a position thereon opposite to the outer block wall, the groove at opposite ends thereof defining two inwardly facing shoulders each for engaging and retaining the abutment portion of a respective one of two abutting blocks such that the abutment portions are retained end to end within the single groove;

wherein there is defined between the abutment portion and the connecting portion a receptacle substantially matching in shape the connecting portion for receiving in interlocking relationship the connecting portion of a co-operating interlocking block.

6. The system according to claim 5 wherein the groove has shoulders substantially at right angles to the outer block wall.

7. The system according to claim 5 the head portion has a hole centrally thereof and extending from the top surface to the bottom surface.

8. The system according to claim 5 wherein the connecting portions are lobe shaped.

9. The system according to claim 5 including a joiner block having an element shaped the same as an abutment portion on the side of the head portion opposite to the outer block wall.

10. The system according to claim 5 including an end block substantially equal to one half of the other blocks.

11. A building wall comprising:

a plurality of interlocking blocks, at least some of the blocks each comprising:

a top surface;

a bottom surface;

an outer block wall defining a side surface of the block;

a head portion extending from the outer block wall toward an opposed side surface;

two connecting portions each on a respective side of the head portion;

two abutment portions each at a respective end of the outer block wall and each defining a respective abutment shoulder on a face of the outer block wall opposite to the side surface thereof;

two receptacles each arranged between a respective one of the abutment portions and a respective one of the connecting portions;

and a single central groove in the head portion at a position thereon opposite to the outer block wall, the groove at opposite ends thereof defining two inwardly facing opposed shoulders;

the blocks being arranged to define a first series of the blocks in which the side surface of each of the first series of blocks is arranged to form a first vertical side surface of the wall and a second series of the blocks which are rotated through 180 degrees in which the side surface of each of the second series of blocks is arranged to form a second vertical side surface of the wall opposite to the first vertical side surface;

the blocks being interlocked such that:

two abutment portions each of a respective one of two adjacent blocks of the second series fit into the single central groove in an opposed one of the blocks of the first series such that the abutment portions are retained end to end within the single groove;

two abutment portions each of a respective one of two adjacent blocks of the first series fit into the single central groove in an opposed one of the blocks of the second series such that the abutment portions are retained end to end within the single groove;

each receptacle of each of the first series of blocks is shaped to receive in interlocking relationship a respective one of the connecting portions of the second series of blocks;

each receptacle of each of the second series of blocks is shaped to receive in interlocking relationship a respective one of the connecting portions of the first series of blocks.

12. The building wall according to claim 11 wherein the groove has shoulders substantially at right angles to the outer block wall.

13. The building wall according to claim 11 wherein the head portion has a hole centrally thereof and extending from the top surface to the bottom surface.

14. The building wall according to claim 11 wherein the connecting portions are lobe shaped.

15. The building wall according to claim 11 including a joiner block having an element shaped the same as an abutment portion on the side of the head portion opposite to the outer block wall.

16. The building wall according to claim 11 including an end block substantially equal to one half of the other blocks.

* * * * *